US006575435B1

(12) United States Patent
Kotzen

(10) Patent No.: US 6,575,435 B1
(45) Date of Patent: Jun. 10, 2003

(54) RETRACTABLE BARRIER SYSTEM

(76) Inventor: Tracy A. Kotzen, 19 Craig Pl., Bloomfield, NJ (US) 07003

( * ) Notice: Subject to any disclaimer, the term of this patent is extended or adjusted under 35 U.S.C. 154(b) by 0 days.

(21) Appl. No.: 10/122,849

(22) Filed: Apr. 12, 2002

(51) Int. Cl.[7] ..... E04H 17/16

(52) U.S. Cl. ..... 256/24; 256/25; 256/1; 160/10; 340/573.4

(58) Field of Search ..... 256/1, 10, 24, 256/25, 73, 37, 39–44; 116/85, 86, 100; 160/10, 23.1, 24; 340/545.7, 573.1, 573.4, 686.4, 687

(56) References Cited

U.S. PATENT DOCUMENTS

| | | | | | |
|---|---|---|---|---|---|
| 484,761 | A | * | 10/1892 | Stromberg | 160/10 |
| 4,005,397 | A | | 1/1977 | Blair | |
| 4,839,632 | A | * | 6/1989 | Zahn, Jr. et al. | 340/550 |
| 4,979,725 | A | * | 12/1990 | Hutchings et al. | |
| 5,102,103 | A | | 4/1992 | Putnam | |
| 5,152,508 | A | * | 10/1992 | Fish | 256/24 |
| 5,249,315 | A | | 10/1993 | Moylan | |
| 5,438,311 | A | * | 8/1995 | Lane, Sr. | |
| 5,660,144 | A | * | 8/1997 | Venti | 256/1 |
| D388,867 | S | | 1/1998 | Baca | |
| 5,771,505 | A | | 6/1998 | Reynolds | |
| 6,119,621 | A | * | 9/2000 | Johnson | 116/63 C |
| 6,119,754 | A | * | 9/2000 | Okonsky | 160/10 |
| 6,435,250 | B1 | * | 8/2002 | Pichik et al. | 160/24 |

FOREIGN PATENT DOCUMENTS

EP 287510 A1 * 10/1988

* cited by examiner

*Primary Examiner*—Gregory J. Binda
*Assistant Examiner*—Michael P. Ferguson

(57) ABSTRACT

A retractable barrier system for preventing unsupervised access to dangerous areas by children. The retractable barrier system includes an housing with an elongate perimeter wall, a bottom wall and a top wall which define an interior space; a barrier assembly positionable within the housing and extending through a slot of the housing; a biasing assembly for selectively retracting the barrier assembly into the housing; a receiving housing for selectively coupling to the barrier assembly; and an alarm assembly positioned within the receiving housing to provide an aural warning when the barrier assembly is disconnected from the receiving housing.

7 Claims, 3 Drawing Sheets

RETRACTABLE BARRIER SYSTEM

BACKGROUND OF THE INVENTION

1. Field of the Invention

The present invention relates to child safety barriers and more particularly pertains to a new retractable barrier system for preventing unsupervised access to dangerous areas by children.

2. Description of the Prior Art

The use of child safety barriers is known in the prior art. More specifically, child safety barriers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,249,315; U.S. Pat. No. 5,102,103; U.S. Pat. No. 5,152,508; U.S. Pat. No. 4,005,397; U.S. Pat. No. 5,771,505; and U.S. Pat. No. Des. 388,867.

While these devices fulfill their respective, particular objectives and requirements, the aforementioned patents do not disclose a new retractable barrier system. The inventive device includes an housing with an elongate perimeter wall, a bottom wall and a top wall which define an interior space; a barrier assembly positionable within the housing and extending through a slot of the housing; a biasing assembly for selectively retracting the barrier assembly into said housing; a receiving housing for selectively coupling to the barrier assembly; and an alarm assembly positioned within the receiving housing to provide an aural warning when the barrier assembly is disconnected from the receiving housing; or tampered with while connected to the receiving housing.

In these respects, the retractable barrier system according to the present invention substantially departs from the conventional concepts and designs of the prior art, and in so doing provides an apparatus primarily developed for the purpose of preventing unsupervised access to dangerous areas by children.

SUMMARY OF THE INVENTION

In view of the foregoing disadvantages inherent in the known types of child safety barriers now present in the prior art, the present invention provides a new retractable barrier system construction wherein the same can be utilized for preventing unsupervised access to dangerous areas by children.

The general purpose of the present invention, which will be described subsequently in greater detail, is to provide a new retractable barrier system apparatus and method which has many of the advantages of the child safety barriers mentioned heretofore and many novel features that result in a new retractable barrier system which is not anticipated, rendered obvious, suggested, or even implied by any of the prior art child safety barriers, either alone or in any combination thereof.

To attain this, the present invention generally comprises an housing with an elongate perimeter wall, a bottom wall and a top wall which define an interior space; a barrier assembly positionable within the housing and extending through a slot of the housing; a biasing assembly for selectively retracting the barrier assembly into said housing; a receiving housing for selectively coupling to the barrier assembly; and an alarm assembly positioned within the receiving housing to provide an aural warning when the barrier assembly is disconnected from the receiving housing; or tampered with while connected to the receiving housing.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new retractable barrier system apparatus and method which has many of the advantages of the child safety barriers mentioned heretofore and many novel features that result in a new retractable barrier system which is not anticipated, rendered obvious, suggested, or even implied by any of the prior art child safety barriers, either alone or in any combination thereof.

It is another object of the present invention to provide a new retractable barrier system which may be easily and efficiently manufactured and marketed.

It is a further object of the present invention to provide a new retractable barrier system which is of a durable and reliable construction.

An even further object of the present invention is to provide a new retractable barrier system which is susceptible of a low cost of manufacture with regard to both materials and labor, and which accordingly is then susceptible of low prices of sale to the consuming public, thereby making such retractable barrier system economically available to the buying public.

Still yet another object of the present invention is to provide a new retractable barrier system which provides in the apparatuses and methods of the prior art some of the advantages thereof, while simultaneously overcoming some of the disadvantages normally associated therewith.

Still another object of the present invention is to provide a new retractable barrier system for preventing unsupervised access to dangerous areas by children.

Yet another object of the present invention is to provide a new retractable barrier system which includes an housing with an elongate perimeter wall, a bottom wall and a top wall which define an interior space; a barrier assembly positionable within the housing and extending through a slot of the housing; a biasing assembly for selectively retracting the barrier assembly into said housing; a receiving housing for selectively coupling to the barrier assembly; and an alarm assembly positioned within the receiving housing to provide an aural warning when the barrier assembly is disconnected from the receiving housing; or tampered with while still connected to the receiving housing.

Still yet another object of the present invention is to provide a new retractable barrier system that is positionable in front of or over bathtubs to prevent scalding or drowning.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
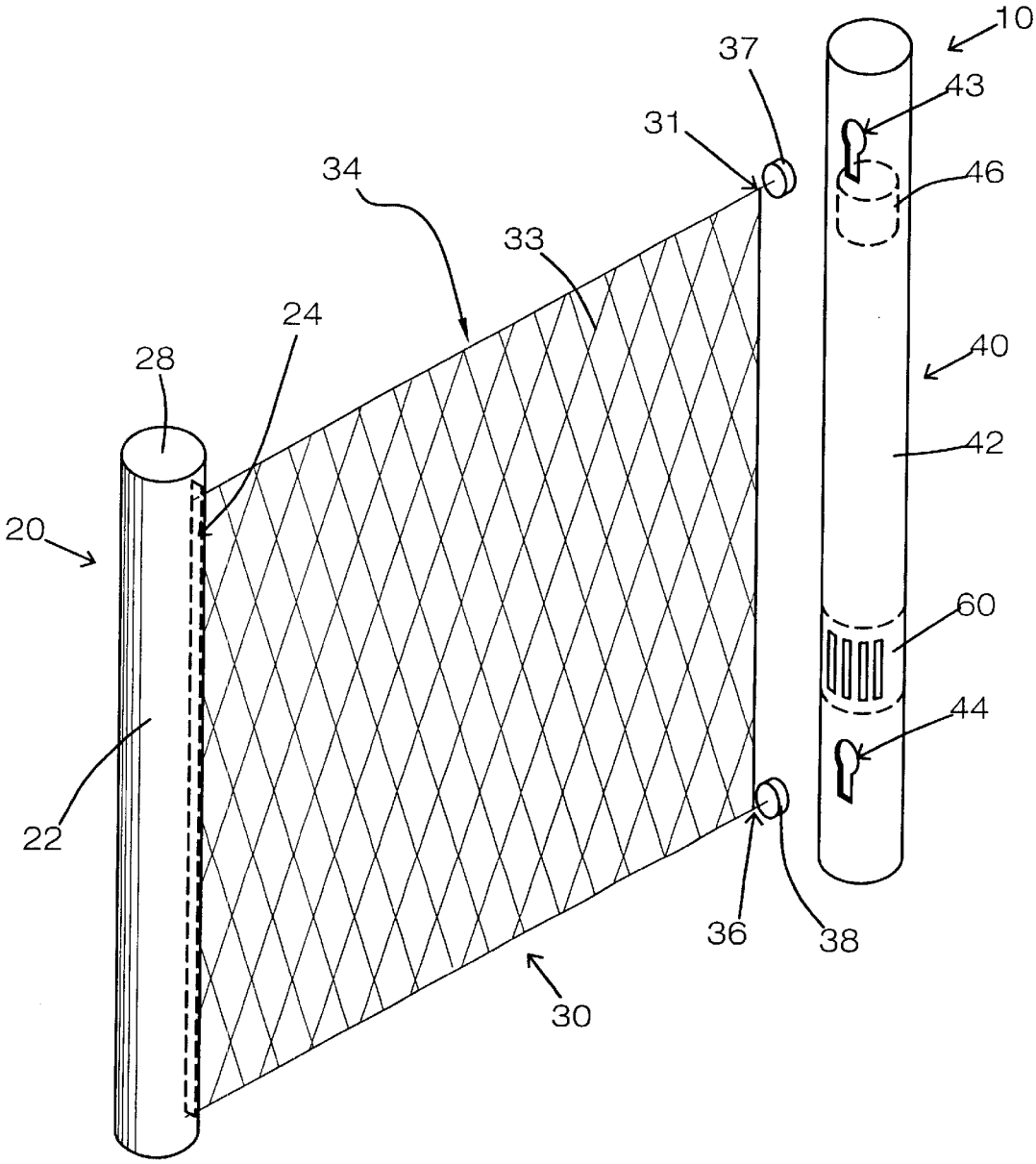
FIG. 1 is a schematic perspective view of a new retractable barrier system according to the present invention.
Figure 2:
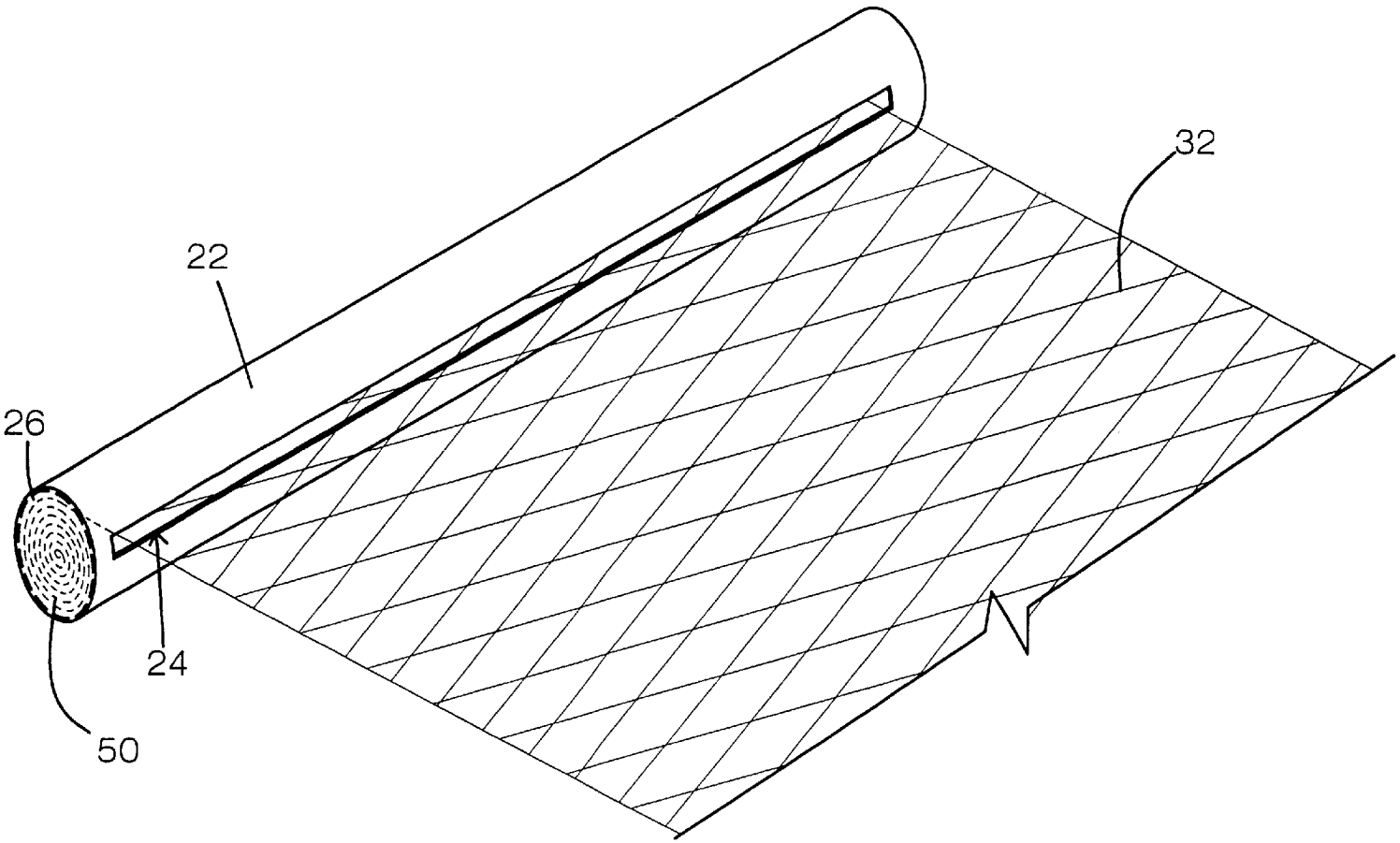
FIG. 2 is a schematic perspective bottom view of the housing of the present invention.
Figure 3:
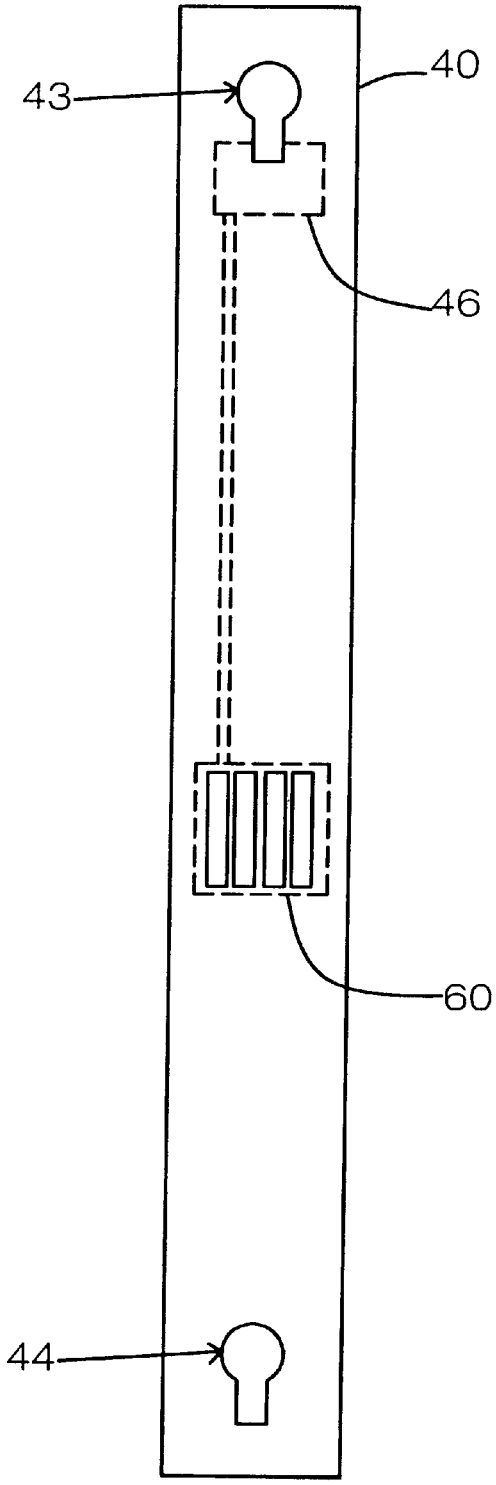
FIG. 3 is a schematic front view of the receiving housing of the present invention.

With reference now to the drawings, and in particular to FIGS. 1 through 3 thereof, a new retractable barrier system embodying the principles and concepts of the present invention and generally designated by the reference numeral 10 will be described.

As best illustrated in FIGS. 1 through 3, the retractable barrier system 10 generally comprises an housing 20, a barrier assembly 30, a biasing assembly 50, a receiving housing 40, and an alarm assembly 60.

The housing 20 includes an elongate perimeter wall 22. The housing 20 also includes a bottom wall 26 and a top wall 28. The perimeter wall 22 along with the top 28 and bottom walls 26 define an interior space. The perimeter wall 22 includes a slot 24, which is positioned such that an axis of the slot 24 is positioned in a substantially spaced parallel relationship with a longitudinal axis of the housing 20.

The barrier assembly 30 is positionable within the housing 20. The barrier assembly 30 includes a first end 31, which extends through the slot 24 of the housing 20.

The biasing assembly 50 for selectively retracting the barrier assembly 30 into the housing 20.

The receiving housing 40 is for selectively coupling to the first end 31 of the barrier assembly 30 such that the barrier assembly 30 is extended from the housing 20.

The alarm assembly 60 is positioned within the receiving housing 40. The alarm 60 provides an aural warning when either the barrier assembly 30 is disconnected from the receiving housing 40, or tampering with the lattice system 34 occurs.

The barrier assembly 30 further comprises a netting portion 32, which provides a surface area for forming a barrier, and a coupling portion 36 for selectively coupling to the receiving housing 40.

In an embodiment the netting portion 32 comprises a lattice 34 of cord members 33. The lattice 34 defines a plurality of opening in a spaced two dimensional array. The lattice 34 provides a barrier to entry for small children. The lattice 34 permits visibility through the barrier assembly 30.

In a further embodiment the lattice 34 defines a plurality of openings which have a maximum dimension of no more than one half inch across.

The coupling portion 36 comprises at least one coupling button 37. The coupling button 37 is substantially elliptical. The coupling button 37 is for slideably engaging a keyhole slot 43. The coupling button 37 is for holding the netting portion 32 in a substantially static extended positioned abutting the receiving housing 40 when the coupling button 37 engages the keyhole slot 43.

The receiving housing 40 further comprises a front wall portion 42 and a sensor member 46. The front wall portion 42 includes at least one keyhole slot 43 for slideably engaging the coupling button 37 of the barrier assembly 30. The sensor member 46 is used for detecting the presence of the coupling button 37 in the keyhole slot 43. The sensor member 46 is operationally coupled to the alarm assembly 60 such that when the coupling button 37 is moved within or removed from the keyhole slot 43 the sensor member 46 triggers the alarm assembly 60.

In an embodiment the coupling portion 36 comprises a first 37 and second coupling button 38. The first coupling button 37 is coupled to a first end of the netting portion 32 adjacent to a top edge. The first coupling button 37 is for selectively securing a top of the barrier assembly 30 to the receiving housing 40. The second coupling button 38 is coupled to the first end of the netting portion 32 adjacent to a bottom edge. The second coupling button 38 is for selectively securing a bottom of the barrier assembly 30 to the receiving assembly 40. Both the first 37 and second coupling buttons 38 are operationally coupled to the sensor member 46 such that movement of either the first 37 or second coupling buttons 38 away from the receiving housing 40 triggers the alarm assembly 60. The receiving housing 40 includes a first 43 and second keyhole slot 44. Each keyhole slot 43,44 is for selectively receiving an associated one of the first 37 and second coupling buttons 38.

In use, the retractable barrier system is positioned across the entryway of a dangerous area. An illustrative example would be placing the retractable barrier system in front of a bathtub to prevent access by a small child. In this illustrative example the housing would be positioned next to one end of the bathtub and may even be coupled to a wall abutting the bathtub. The receiving housing would then be positioned next to the opposite end of the bathtub and again may be coupled to an abutting wall. When the barrier is desired by the user, the barrier assembly is extended through the slot towards the receiving housing. Each of the coupling button is engaged by the associated keyhole slot and the barrier assembly is held in position. When the barrier is no longer desired by the user, the coupling buttons are disengaged from the associated keyhole slots and the biasing assembly located in the housing retracts the barrier assembly.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and, all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A retractable barrier system for preventing injury to small children comprising:

a housing having an elongate perimeter wall, said housing having a bottom wall and a top wall, said perimeter wall along with stick top and bottom walls defining an interior space, said perimeter wall having a slot positioned such that an axis of said slot is positioned in a substantially spaced parallel relationship with a longitudinal axis of said housing;

a barrier assembly positionable within said housing; said barrier assembly having a first end extending through said slot of said housing, said barrier assembly having a coupling portion;

a biasing assembly for selectively retracting said barrier assembly into said housing;

a receiving housing for selectively coupling said first end of said barrier assembly such that said barrier assembly is extended from said housing;

wherein said coupling portion comprises at least one coupling button, said coupling button being substantially elliptical, said coupling button being for slideably engaging a keyhole slot, said coupling button being for holding said barrier assembly in a substantially static extended position abutting said receiving housing when said coupling button engages said keyhole slot;

an alarm assembly positioned within said receiving housing, said alarm providing an aural warning when said barrier assembly is disconnected from said receiving housing, said alarm assembly providing an aural warning when tampering with said barrier assembly occurs after said barrier assembly has been positioned in said receiving housing;

a sensor member for detecting the presence of said coupling button said keyhole slot, said sensor member being operationally coupled to said alarm assembly such that when said coupling button is moved within said keyhole slot said sensor member triggers said alarm assembly.

2. The retractable barrier system of claim 1, wherein said barrier assembly further comprises:

a netting portion providing a surface area for forming a barrier.

3. The retractable barrier system of claim 2, wherein said netting portion comprises a lattice of cord members, said lattice defining a plurality of openings in a spaced two dimensional array, said lattice providing a barrier to entry for small children, said lattice permitting visibility through said barrier assembly.

4. The retractable barrier system of claim 3, wherein said lattice defines a plurality of openings having a maximum dimension of no more than one half inch across.

5. The retractable barrier system of claim 1, wherein said receiving housing further comprises:

a front wall portion said front wall portion having at least one keyhole slot for slideably engaging said coupling button of said barrier assembly.

6. A retractable barrier system for preventing injury to small children comprising:

an housing having an elongate perimeter wall, said housing having a bottom wall and a top wall, said perimeter wall along with said top and bottom walls defining an interior space, said perimeter wall having a slot positioned such that an axis of said slot is positioned in a substantially spaced parallel relationship with a longitudinal axis of said housing;

a barrier assembly positionable within said housing; said barrier assembly having a first end extending through said slot of said housing;

a biasing assembly for selectively retracting said barrier assembly into said housing;

a receiving housing for selectively coupling said first end of said barrier assembly such that said barrier assembly is extended from said housing;

an alarm assembly positioned within said receiving housing, said alarm providing an aural warning when said barrier assembly is disconnected from said receiving housing;

said barrier assembly further comprises:

a netting portion providing a surface area for forming a barrier;

a coupling portion for selectively coupling to said receiving housing;

wherein said netting portion comprises a lattice of cord members, said lattice defining a plurality of openings in a spaced two dimensional array, said lattice providing a barrier to entry for small children, said lattice permitting visibility through said barrier assembly;

wherein said lattice defines a plurality of openings having a maximum dimension of no more than one half inch across;

wherein said coupling portion comprises at least one coupling button, said coupling button being substantially elliptical, said coupling button being for slideably engaging a keyhole slot, said coupling button being for holding said netting portion in a substantially static extended position abutting said receiving housing when said coupling button engages said keyhole slot;

said receiving housing further comprises:

a front wall portion, said front wall portion having at least one keyhole slot for slideably engaging a coupling button of said barrier assembly; and a sensor member for detecting the presence of said coupling button in said keyhole slot, said sensor member being operationally coupled to said alarm assembly such that when said coupling button is moved within said keyhole slot said sensor member triggers said alarm assembly.

7. The retractable barrier system of claim 6 further comprising:

wherein said coupling portion comprises a first cold second coupling button, said first coupling button being coupled to a first end of said netting portion adjacent to a top edge, said First coupling button being for selectively securing a top of said barrier assembly to said receiving housing, said second coupling button being coupled to said first end of said netting portion adjacent to a bottom edge, said second coupling button being for selectively securing a bottom of said barrier assembly to said receiving housing, both said first and second coupling buttons being operationally coupled to said sensor member such that movement of either said first or second coupling buttons within said receiving housing triggers said alarm assembly;

wherein said receiving housing having a first and second keyhole slot, each keyhole slot being for selectively receiving an associated one of said first and second coupling buttons.

* * * * *